US009803582B2

(12) United States Patent
Baek et al.

(10) Patent No.: US 9,803,582 B2
(45) Date of Patent: Oct. 31, 2017

(54) CYLINDER BLOCK FOR ENGINE OF VEHICLE

(71) Applicant: Hyundai Motor Company, Seoul (KR)

(72) Inventors: Hong Kil Baek, Seoul (KR); In Woong Lyo, Gyeonggi-do (KR); Jiyoun Seo, Gyeonggi-do (KR); Bokyung Kim, Gyeonggi-do (KR); Seung Woo Lee, Seoul (KR); Tae Won Lee, Incheon (KR)

(73) Assignee: Hyundai Motor Company, Seoul (KR)

( * ) Notice: Subject to any disclaimer, the term of this patent is extended or adjusted under 35 U.S.C. 154(b) by 74 days.

(21) Appl. No.: 14/874,559

(22) Filed: Oct. 5, 2015

(65) Prior Publication Data

US 2016/0326979 A1 Nov. 10, 2016

(30) Foreign Application Priority Data

May 7, 2015 (KR) ..... 10-2015-0063553

(51) Int. Cl.
*F02F 1/14* (2006.01)

(52) U.S. Cl.
CPC ..... *F02F 1/14* (2013.01); *F05C 2251/048* (2013.01)

(58) Field of Classification Search
CPC ... B22D 19/0081; B22D 13/102; F02F 1/004; F02F 1/12; F02F 1/16; F02F 7/0085; F02F 7/0087; F02F 11/002; F02F 11/005; C08L 67/02
See application file for complete search history.

(56) References Cited

U.S. PATENT DOCUMENTS 6,743,841 B2 * 6/2004 Shimizu ..... C08G 79/025 428/416
8,037,860 B2 10/2011 Takami et al.
8,096,270 B2 * 1/2012 Yamada ..... B22D 19/00 123/193.2
2002/0161077 A1 * 10/2002 Shimizu ..... C08G 79/025 524/115
2012/0088855 A1 * 4/2012 Gawryla ..... B01J 13/0091 521/91
2013/0055993 A1 * 3/2013 Kantola ..... C23C 4/10 123/668

(Continued)

FOREIGN PATENT DOCUMENTS

JP 2014-231791 A 12/2014
KR 10-2010-0033396 A 3/2010

(Continued)

OTHER PUBLICATIONS

Yoon, Jong-Kuk et al., "A Study on Properties of Thermal Insulation Board Prepared by Porous Silica Aerogel", The Transactions of the Korean Institute of Electrical Engineers, vol. 61, No. 9, pp. 1362-1367 (2012).

*Primary Examiner* — Long T Tran
(74) *Attorney, Agent, or Firm* — Mintz Levin Cohn Ferris Glovsky and Popeo, P.C.; Peter F. Corless

(57) ABSTRACT

A cylinder block for an engine includes a cylinder liner and a water jacket through which a coolant flows, the water jacket being formed along a circumference of the cylinder liner, where an insulation coating layer made of a polyamideimide resin and an aerogel dispersed in the polyamideimide resin may be formed at an external circumferential surface of the cylinder liner.

9 Claims, 3 Drawing Sheets

(56) References Cited

U.S. PATENT DOCUMENTS

| | | | | |
|---|---|---|---|---|
| 2015/0204233 | A1* | 7/2015 | Nanba | F02F 1/18<br>123/668 |
| 2015/0300289 | A1* | 10/2015 | Baek | F02F 1/24<br>123/193.5 |

FOREIGN PATENT DOCUMENTS

| | | | |
|---|---|---|---|
| KR | 10-1083133 | B1 | 11/2011 |
| KR | 2011-0132233 | A | 12/2011 |
| WO | 2009-020206 | A1 | 2/2009 |

* cited by examiner

CYLINDER BLOCK FOR ENGINE OF VEHICLE

CROSS-REFERENCE TO RELATED APPLICATION

The present application claims under 35 U.S.C. §119(a) the benefit of Korean Patent Application Number 10-2015-0063553 filed on May 7, 2015, the entire contents of which are incorporated herein by reference.

BACKGROUND (a) Field of the Invention

The present invention relates to an engine for a vehicle, more particularly, to a cylinder block of the engine in which a temperature distribution of a cylinder liner along a height direction of a water jacket of the cylinder block can be uniformly maintained.

(b) Description of the Related Art

In general, an internal combustion engine converts heat energy by applying combustion gas generated by combusting a fuel to a piston or a turbine blade.

The internal combustion engine generally refers to an engine having reciprocal motion to move a piston by igniting a mixed gas of a fuel and air inside a cylinder, where the internal combustion engine can be provided in a vehicle. Also, a gas turbine engine, a jet engine, and a rocket engine are other types of internal combustion engines.

The internal combustion engine may be classified into a gas engine, a gasoline engine, and a petroleum engine according to a fuel used.

A petroleum gas gasoline engine is ignited by an electric spark of a spark plug, and a diesel engine is naturally ignited by injecting a fuel in high temperature and high pressure air.

A stroke type of the piston of the internal combustion engine includes a 4 stroke cycle type and a 2 stroke cycle type.

In general, it is known that the internal combustion engine of a vehicle has heat efficiency in the range of about 15% to 35%. However, about 60% or greater of the total heat energy may be consumed due to heat energy and exhaust gas released to the outside through a wall of the internal combustion engine even when the internal combustion engine is operating at maximum efficiency.

Since the efficiency of the internal combustion engine may be increased when an amount of heat energy to be released to the outside through a wall of the internal combustion engine is reduced, a method in which an insulation material is installed outside of the internal combustion engine, a part of a material or a structure of the internal combustion engine is changed, or a cooling system of the internal combustion engine is changed has been developed.

Particularly, the efficiency of the internal combustion engine and fuel consumption of a vehicle may be improved by minimizing release of heat generated in the internal combustion engine to the outside along a wall of the internal combustion engine. However, research into an insulation material or an insulation structure capable of being maintained for an extended time inside the internal combustion engine to which repeated high temperature and high pressure conditions are applied has not been resulted in suitable replacement materials or structures.

The above information disclosed in this section is only for enhancement of understanding of the background of the invention and therefore it may contain information that does not form the prior art that is already known in this country to a person of ordinary skill in the art.

SUMMARY

Various aspects of the present invention are directed to providing a cylinder block for an engine of a vehicle, in which the cylinder block uniformly maintains a temperature distribution of a cylinder liner along a height direction of a water jacket by applying an insulation coating layer to an external circumferential surface of a lower portion of the cylinder liner of the cylinder block. Preferably, the insulation coating layer ensures high mechanical properties and heat resistance while having low thermal conductivity and low volume heat capacity.

An exemplary cylinder block for an engine according to the present invention may include a cylinder liner and a water jacket through which a coolant flows, the water jacket being formed along a circumference of the cylinder liner, wherein an insulation coating layer comprising a polyamideimide resin and an aerogel dispersed in the polyamideimide resin may be formed at an external circumferential surface of the cylinder liner.

The insulation coating layer may be formed at an external circumferential surface of a lower portion of the cylinder liner.

The insulation coating layer may have a thermal conductivity of about 0.60 W/mK or less.

The insulation coating layer may have heat capacity of about 1250 KJ/m$^3$ K or less.

An amount of about 2 wt % or less of the polyamideimide resin based on the total weight of the polyamideimide resin may be included in the aerogel.

The polyamideimide resin may be not included at a depth of about 5% or greater of a longest diameter from a surface of the aerogel.

The aerogel may have a pore rate in a range of about 92% to 99% as being dispersed in the polyamideimide resin.

The insulation coating layer may have a thickness in a range of about 50 μm to 500 μm.

The insulation coating layer may comprise the aerogel in an amount of about 5 to 50 parts by weight based on the polyamideimide resin at 100 parts by weight.

An exemplary cylinder block for an engine according to the present invention may include a cylinder liner and a water jacket through which a coolant flows, the water jacket being formed along a circumference of the cylinder liner, wherein an insulation coating layer may be formed at an external circumferential surface of a lower portion of the cylinder liner, wherein the insulation coating layer may comprise a polyamideimide resin and an aerogel dispersed in the polyamideimide resin and have a thermal conductivity of about 0.60 W/mK or less and heat capacity of about 1250 KJ/m$^3$ K or less, and wherein the polyamideimide resin may be included at a depth of about 95% or less of a longest diameter from a surface of the aerogel.

BRIEF DESCRIPTION OF THE DRAWINGS

In the following detailed description, only certain exemplary embodiments of the present invention have been shown and described, simply by way of illustration.

DETAILED DESCRIPTION OF THE EMBODIMENTS

Figure 1:
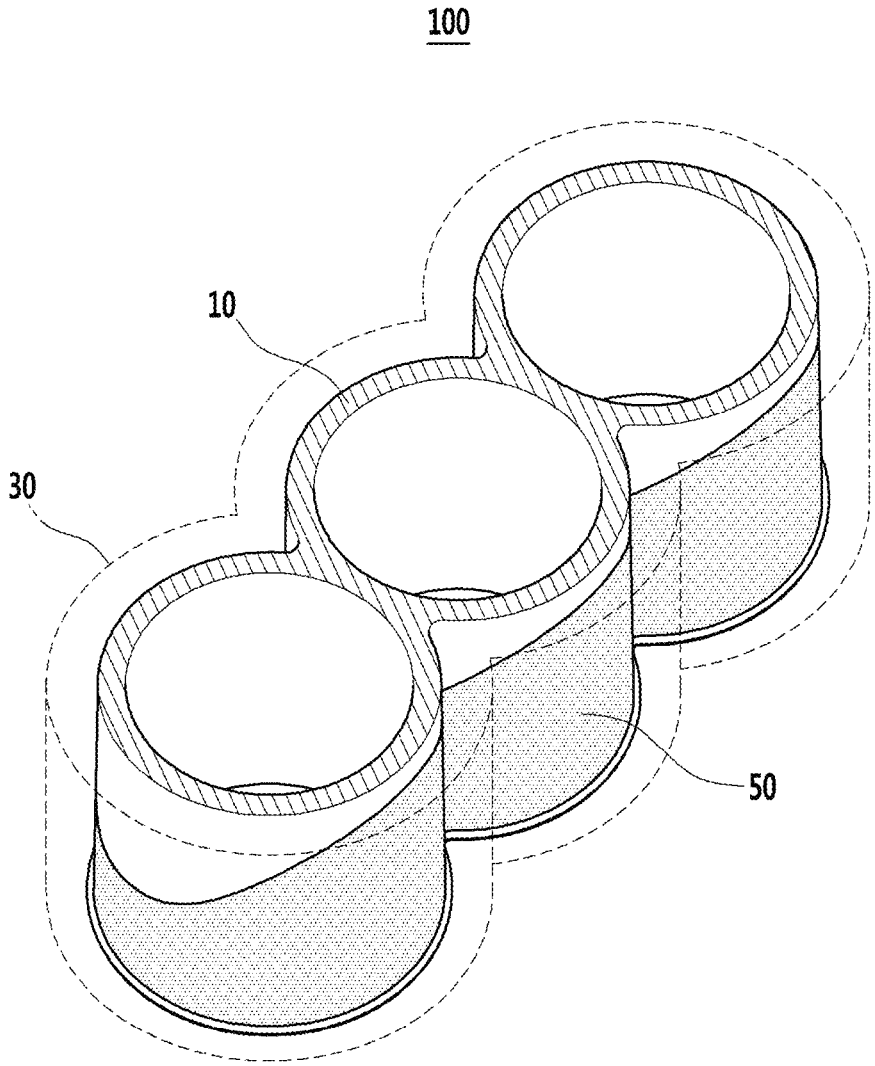
FIG. 1 is a perspective view of a cylinder block for an engine according to the present invention.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. For the purpose of clear description of an exemplary embodiment of the present invention, parts which are not related to the description are omitted. The same reference numbers are used throughout the specification to refer to the same or like parts.

Further, the size and thickness of each configuration shown in the drawings are optionally illustrated for better understanding and ease of description, the present invention is not limited to shown drawings, and the thicknesses are exaggerated for clarity of a plurality of parts and regions. The terms "first" and "second" can be used to refer to various components, but the components may not be limited to the above terms. The present invention is not limited to the order. Throughout this specification, in addition, unless explicitly described to the contrary, the word "comprise" and variations such as "comprises" or "comprising" will be understood to imply the inclusion of stated elements but not the exclusion of any other elements. Further, the terms " . . . unit", " . . . means", " . . . part", and " . . . member" described in the specification refer to a unit of a general configuration processing at least one function or operations.

FIG. 1 is a perspective view of a partly cut cylinder liner, schematically illustrating an exemplary cylinder block for an engine according to the present invention.

Referring to FIG. 1, an exemplary cylinder block 100 for an engine according to the present invention may be applied to an engine of a vehicle.

A cylinder block 100 forms a basis of a main body of an engine and comprises a block structure preferably cast as one structure together with a plurality of cylinders, and a cylinder head is mounted on the cylinder block 100.

Hereinafter, although the cylinder block 100 according to an exemplary embodiment of the present invention is applied to the engine of a vehicle by way of example, it should be understood that the scope of the present invention is not limited thereto. The structure of a cylinder block as described herein may be applied to various types and purposes of internal combustion engines such as a gas turbine, a jet engine, and a rocket engine.

An exemplary cylinder block 100 for an engine according to the present invention may include one or more cylinder liners 10. In particular, the cylinder liners 10 correspond to cylinder bores, respectively, and a water jacket 30 may be formed along a circumference of the cylinder liners 10.

A piston (not shown) may be mounted inside the cylinder liner 10 so as to move up and down through a piston ring.

The water jacket 30 forms coolant passages through which a coolant supplied from a water pump flows towards external circumferential surfaces of the cylinder liners 10.

Detailed explanations will be omitted because configuration of a cylinder liner and a water jacket are generally known to a skilled person in the art.

In general, coolant inside the water jacket 30 in the cylinder block 100 flows in a horizontal direction by pressure discharged from a water pump.

Further, there also exist flows performing heat exchange in a vertical direction among flow paths in horizontal directions according to differences of amounts of heat transferred from the cylinder block 100.

Regarding coolant flow inside the water jacket 30, a temperature of the cylinder liner 10 decreases because of an increase of heat transfer coefficient when a speed of coolant flow is fast. On the contrary, the temperature of the cylinder liner 10 increases when a speed of coolant flow is slow.

In particular, an upper end portion of the cylinder block 100 has a large heat load by heat transferred from a combustion chamber, and a lower end portion of the cylinder block 100 has a relatively small heat load.

Based on the above-described condition, the cylinder liner 10 may be over-heated at an upper end portion of the cylinder block 100 and may be relatively over-cooled at a lower end portion of the cylinder block 100.

As a result, temperature distribution of the cylinder liner 10 shows that an upper end side maintains a higher temperature than a lower end side, based on stroke directions of a piston.

Similarly, temperature distribution of an upper end side of the cylinder liner 10 is maintained higher than that of a lower end side, and thereby oil temperature inside a gallery may decrease.

Such an oil temperature decrease can cause excessive friction between a piston and a surface of the cylinder liner 10. In particular, in case of reciprocal motions of the piston, this problem results in a power loss of the engine on account of an increase of piston friction resistance, and thus fuel consumption deteriorates.

In addition, deformation of a cylinder bore may occur due to non-uniform distribution of temperature of coolant flowing inside the water jacket 30, and application of a low tension piston ring for coping with an increase of oil consumption or fuel consumption becomes difficult on account of the deformation of a cylinder bore.

Further, due to flow speed difference of coolant through the water jacket 30 and an effect of combustion gas, temperature deviation of the cylinder liner 10 along a height direction of the water jacket 30 such as a stroke direction of a piston may occur.

An exemplary method for preventing the above-described problem is to increase temperature of a lower end portion side of the cylinder liner 10 by installing a spacer inside the water jacket 30 and reducing flow speed of the lower end portion side of the cylinder liner 10. However, this method may result in increased cost due to producing and installing the spacer, and it becomes difficult to secure adequate space for installing the spacer inside the water jacket 30.

In addition, the above mentioned temperature deviation of the cylinder liner 10 along the height direction of the water jacket 30 may cause noise generation by enlarging a gap between the piston and the cylinder liner 10 and deteriorate durability of the cylinder liner 10.

An exemplary cylinder block 100 according to the present invention is configured to be able to uniformly maintain temperature distribution of the cylinder liner 10 along the height direction of the water jacket 30.

To do this, the exemplary cylinder block 100 according to the present invention may include an insulation coating layer 50 formed by being coated at an external circumferential surface of the cylinder liner 10.

In an exemplary embodiment of the present invention, the insulation coating layer 50 may be formed at an external circumferential surface of a lower end portion of the cylinder liner 10 lower than a center portion, based on a height direction of the cylinder liner 10.

The insulation coating layer 50 has high mechanical properties and heat resistance while having low thermal conductivity and low volume heat capacity.

Hereinafter, the insulation coating layer 50 may be applied to the cylinder block 100 for the engine, and an insulation coating composition thereof will be described in detail.

The present invention may provide an insulation coating composition that may include: a polyamideimide resin dispersed in a first solvent and an aerogel dispersed in a second organic solvent. The first solvent may be a solvent having high boiling point organic or an aqueous solvent, and the second solvent may have a low boiling point.

Moreover, the insulation coating layer may include a polyamideimide resin and an aerogel dispersed in the polyamideimide resin, and thus, the insulation layer may have a thermal conductivity of about 0.60 W/mK or less. As used herein, the "high boiling point" means a boiling temperature of a solvent of about 110° C. or greater, and the "low boiling point" means a boiling temperature of a solvent of about 110° C. or less. Further, the "aqueous solvent" refers to a solvent or a solvent system that may include at least a portion of water, or further, that may be water-soluble or be mixed with water without separation. For example, according to exemplary embodiments of the present invention, water, methanol, ethanol, ethyl acetate, other polar solvent that may be water soluble, and mixtures thereof may be used as an aqueous solvent.

According to an exemplary embodiment of the present invention, an insulation coating composition may include: a polyamideimide resin dispersed in a high boiling point organic solvent or an aqueous solvent; and an aerogel dispersed in a low boiling point organic solvent.

Inventors of the present invention have confirmed through the experiments to obtain the invention that when a coating composition obtained by dispersing the polyamideimide resin and the aerogel in each predetermined solvent, i.e. the first solvent and the second solvent, respectively, and by mixing the polyamideimide resin and the aerogel with predetermined solvents is used, and a coating layer obtained therefrom may have improved mechanical material property and heat resistant property. Meanwhile, thermal conductivity and density of the coating layer may be reduced. Accordingly, the coating composition may be applied to the internal combustion engine such that heat energy released to the outside may be reduced to improve the efficiency of the internal combustion engine and fuel consumption of the vehicle.

In recent years, methods of using aerogel or air-gel in fields such as for a heat insulating material, an impact buffer material, or a sound proofing material have been proposed.

The aerogel has a structure where fine fibers having a thickness of about 1/10,000 of a hair are entangled and the aerogel may form a pore rate of about 90% or greater. The pore rate of a coating is defined as a ratio of volume of void of the coating per total volume of the coating. Exemplary material of the aerogel may include silicon oxide, carbon, or an organic polymer.

Particularly, the aerogel may have a substantially low density and high transparency and very low thermal conductivity because of the above structural characteristic.

However, even though the aerogel has an excellent insulation characteristics, since the aerogel may be easily broken from a small impact due to high brittleness, and has a difficulty in being processed into various thicknesses and forms, there may be a limitation in using it as a heat insulating material. Further, when the aerogel is mixed with other reaction materials, a solvent or solute may penetrate into the aerogel so that viscosity of a resulting aerosol material may be increased and mixing may not be sufficiently performed. Accordingly, the aerogel has not been used as being integrated with other materials or as being mixed with other materials that do not have the porosity as the aerogel.

In contrast, in an example of the insulation coating composition, the polyamideimide resin may be dispersed in a first solvent, such as the high boiling point organic solvent or the aqueous solvent, and the aerogel may be dispersed in a second solvent that may be the low boiling point organic solvent. Accordingly, a dispersion phase of the polyamideimide resin in the first solvent may not be combined with a dispersion phase of the aerogel in the second solvent to be uniformly mixed with each other, and the insulation coating composition may also have a uniform composition Further, since the first solvent such as high boiling point organic solvent or the aqueous solvent and the second solvent such as low boiling point organic solvent may not be easily dissolved or mixed with each other, the first solvent and the second solvent may be mixed with each other when the polyamideimide resin is dispersed in the first solvent and the aerogel is dispersed in the second solvent. Accordingly, before the example of the insulation coating composition is coated and dried, direct contact between the polyamideimide resin and the aerogel may be minimized, and the polyamideimide resin may be prevented from penetrating or impregnating into pores of the aerogel.

Moreover, since the second solvent such as low boiling point organic solvent has a predetermined affinity with the first solvent such as high boiling point organic solvent or the aqueous solvent, the second solvent may allow the aerogel dispersed therein to be physically mixed with the first solvent to be uniformed distributed, and allow the polyamideimide resin to be uniformly distributed in the first solvent. Accordingly, an insulation coating layer obtained from the example of the insulation coating composition may ensure an equivalent physical material of the aerogel, and the aerogel may be uniformly dispersed in the polyamideimide resin thereby improving mechanical properties, heat resistant property, and insulation characteristics.

That is, as described above, the insulation coating layer obtained from the example of the insulation coating composition may maintain the equivalent level of the material property and structure of the aerogel, high mechanical properties, and heat resistant property may be ensured while representing low thermal conductivity and a low density, and thus, the insulating coating layer may be applied to an internal combustion engine such that externally released heat energy may be reduced to improve efficiency of the internal combustion engine and fuel consumption of the vehicle.

For example, as shown in FIG. 1, the insulation coating layer 50 may be applied to an external circumferential surface of a lower end portion side of the cylinder liner 10 for uniformly maintaining temperature distribution of the cylinder liner 10 along a height direction of the water jacket 30.

As described above, the insulation coating composition may be formed by mixing the polyamideimide resin dispersed in the high boiling point organic solvent or the aqueous solvent with the aerogel dispersed in the low boiling point organic solvent. The mixing method may not be particularly limited, but may be a generally known physical mixing method in the related arts.

For example, when the two types of solvent dispersion phases may be mixed with each other, silica beads may be added to the mixture, and ball milling may be performed at a room temperature under normal pressure condition at speed of about 100 to 500 rpm to manufacture a coating composition (coating solution). However, the method of mixing the solvent of the polyamideimide resin with the solvent of the aerogel may not be limited to the above example.

The example of the insulation coating composition may provide an insulation material or an insulation structure which may be maintained for a long time inside the internal combustion engine to which high temperature and high pressure condition are repeatedly applied. In detail, the example of the insulation coating composition may be used to as a coating material of an internal surface of the internal combustion engine or a component of the internal combustion engine. In particular, as described above, the example of the insulation coating composition may be used to coat an outer surface of a cylinder liner.

An example of the polyamideimide resin included in the insulation coating composition may not be limited, but the polyamideimide resin may have a weight average molecular weight of about 3000 to 300,000, or particularly of about 4000 to 100,000.

When the weight average molecular weight of the polyamideimide resin is less than the predetermined value, for example, less than about 3000, it may be difficult to obtain sufficient mechanical properties or heat resistant property and insulation property of the coating layer or a coating film obtained from the insulation coating composition, and a polymer resin may easily penetrate into the aerogel.

Further, when the weight average molecular weight of the polyamideimide resin is greater than the predetermined value, for example, greater than about 300,000, uniformity of the coating layer or a coating film obtained from the insulation coating composition may be deteriorated, dispersion of the aerogel in the insulation coating composition may be deteriorated, or blockage of a nozzle and the like of a coating device upon coating the insulation coating composition may occur. In addition, it may take extended time to perform heat treatment of the insulation coating composition and the heat treatment temperature may be increased.

A generally known aerogel may be used as the aerogel. In detail, an aerogel of a component including a silicon oxide, carbon, a polyimide, a metal carbide, or a mixture of at least two thereof may be used as the aerogel. The aerogel may have a specific surface area of about 100 $cm^3/g$ to 1000 $cm^3/g$, or particularly, of about 300 $cm^3/g$ to 900 $cm^3/g$.

The insulation coating composition may include the aerogel in an amount of about 5 to 50 parts by weight, or particularly in an amount of about 10 to 45 parts by weight, based on 100 parts by weight of the polyamideimide resin. A weight ratio of the polyamideimide resin to the aerogel may be a weight ratio of a solid content excluding the dispersion solvent.

When the content of the aerogel based on the polyamideimide resin is less than the predetermined amount, for example, less than about 5 parts by weight, it may be difficult to reduce thermal conductivity and a density of the coating layer or a coating film obtained from the insulation coating composition, and a heat resistant property of an insulation layer manufactured from the insulation coating composition may be reduced.

When the content of the aerogel based on the polyamideimide resin is greater than the predetermined amount, for example, greater than about 50 parts by weight, it may be difficult to sufficiently obtain mechanical properties of the coating layer or a coating film obtained from the insulation coating composition, and cracks may occur in an insulation layer manufactured from the insulation coating composition or it may be difficult to firmly maintain a coating form of the insulation layer.

Although the solid content of the polyamideimide resin in the first solvent such as the high boiling point organic solvent or the aqueous solvent may not be limited, the solid component of polyamideimide may be in the range of about 5 wt % to 75 wt % based on the total weight of the first solvent in consideration of the uniformity or a material property of the insulation coating composition.

Although the solid content of the aerogel in the second solvent such as the low boiling point organic solvent may not be limited, the solid component may be in the range of about 5 wt % to 75 wt % based on the total weight of the second solvent in consideration of the uniformity or the material property of the insulation coating composition.

As described above, since the first solvent and the second solvent are not easily dissolved or mixed with each other, before the insulation coating composition is coated and dried, direct contact between the polyamideimide resin and the aerogel may be minimized, and the polyamideimide resin may be prevented from penetrating or impregnating into the inside of pores of the aerogel.

In particular, the difference in boiling temperature between the first solvent and the second solvent may be about 10° C. or higher, or about 20° C. or greater, or particularly, in a range of about 10 to 200° C. The first solvent may be an organic solvent having a boiling temperature of 110° C. or greater.

For example, the first solvent may be selected from the group consisting of anisole, toluene, xylene, methyl ethyl ketone, methyl iso-butyl ketone and ethylene glycol monomethyl ether, ethylene glycol monoethyl ether, ethylene glycol mono-butyl ether, acetic butyl, cyclohexanone, ethylene glycol monoethyl ether acetate (BCA), benzene, hexane, DMSO, N,N'-dimethylformamide, and a mixture of at least two thereof.

The second solvent may be an organic solvent having a boiling temperature of about 110° C. or less.

For example, the low boiling point organic solvent may be selected from the group consisting of methyl alcohol, ethyl alcohol, propyl alcohol, n-butyl alcohol, iso-butyl alcohol, tert-butyl alcohol, acetone, methylenechloride, ethylene acetate, isopropyl alcohol, and a mixture of at least two thereof.

Further, the first solvent may be an aqueous solvent that may be selected from the group consisting of water, methanol, ethanol, ethyl acetate, and a mixture of at least two thereof.

According to an example of the present invention, the aqueous solvent may include a polyamideimide resin and an aerogel in the polyamideimide resin, for example, as being dispersed, and the thus prepared insulation coating layer may have a thermal conductivity of 0.60 W/mK or less.

Inventors of the present invention have manufactured an insulation coating layer to have improved mechanical properties and heat resistant property while having low thermal conductivity and low density using the exemplary insulation coating composition as described above. As consequence, the efficiency of the internal combustion engine and fuel consumption of the vehicle may be improved by reducing heat energy released to the outside and temperature distribution of a cylinder liner may be uniformly maintained as the insulation coating layer is applied to the internal combustion engine and particularly, to an external circumferential surface of a lower end portion side of a cylinder liner.

The aerogel may be uniformly dispersed in the insulation coating layer through the entire region of the polyamideimide resin. Accordingly, a material property, for example, low thermal conductivity and low density implemented from the aerogel may be easily ensured. Further, properties obtained from the polyamideimide resin, for example, high mechanical properties and a heat resistant property, may be implemented with an equivalent level when only the polyamideimide resin is used.

The insulation coating layer may provide low thermal conductivity and improved heat capacity. In detail, the insulation coating layer may have thermal conductivity of about 0.60 W/mK or less, or 0.55 W/mK or less, or may be in the range of about 0.60 W/mK to 0.200 W/mK. The insulation coating layer may have heat capacity of about 1250 $KJ/m^3$ K or less, or particularly of about 1000 to 1250 $KJ/m^3$ K.

As described above, since the example of the insulation coating composition includes the polyamideimide resin dispersed in the first solvent such as the high boiling point organic solvent or the aqueous solvent, and the aerogel dispersed in the second solvent such as the low boiling point organic solvent, and direct contact between the polyamideimide resin and the aerogel may be minimized before the coating composition is coated and dried, the polyamideimide resin may be prevented from penetrating or impregnating into the inside of pores of the aerogel included in the finally manufactured insulation coating layer.

In detail, the polyamideimide resin may not be substantially included in the aerogel dispersed in the polyamideimide resin. For example, an amount of about 2 wt % or less, or particularly of about 1 wt % or less of the polyamideimide resin may be included in or penetrate the aerogel.

In addition, the aerogel may be included in the polyamideimide resin, for example, as being dispersed, in the insulation coating layer. In this case, the outside of the aerogel may make contact with or be coupled with the polyamideimide resin, but the polyamideimide resin may not be included inside the aerogel. In particular, the polyamideimide resin may not be included or penetrate at a depth of about 5% or greater of the longest diameter from a surface of the aerogel included in the insulation coating layer.

That is, the polyamideimide resin may be included at a depth of about 95% or less of a longest diameter from a surface of the aerogel the air.

Since the polyamideimide resin is not penetrated or impregnated into the inside or pores of the aerogel, the aerogel may maintain a pore rate of an equivalent level before or after being dispersed in the polyamideimide resin. In particular, each aerogel included in the insulation coating layer may have a pore rate in the range of about 92% to 99% while being dispersed in the polyamideimide resin.

The insulation coating layer may provide an insulation material or an insulation structure which may be maintained for extended time inside the internal combustion engine to which the high temperature and high pressure condition is repeatedly applied. The exemplary insulation coating layer may be formed on an internal surface of the internal combustion engine or a component of the internal combustion engine. Furthermore, as described above, the exemplary insulation coating layer may be formed on the surface of the cylinder liner.

A thickness of the insulation coating layer may be determined according to an applied field or position or a required material property. For example, the thickness of the insulation coating layer may be in the range of about 50 μm to 500 μm. The example of the insulation coating layer may include the aerogel in an amount about 5 to 50 parts by weight, or 10 to 45 parts by weight, based on 100 parts by weight of the polyamideimide resin excluding the solvent content.

If a content of the aerogel is less than the predetermined amount, for example, less than about 5 parts by weight, based on the polyamideimide resin, it may be difficult to reduce the thermal conductivity of the insulation coating layer and the density, to sufficiently ensure the heat resistant property, and to reduce the heat resistant property of the insulation coating layer.

Further, if the content of the aerogel is greater than the predetermined amount, for example, greater than about 50 parts by weight, based on the polyamideimide resin, it may be difficult to sufficiently obtain mechanical material properties of the insulation coating layer, and cracks may occur in the insulation coating layer or it may be difficult to firmly maintain a coating form of the insulation layer.

The polyamideimide resin may have a weight average molecular weight in the range of about 3000 to 300,000 or particularly of about 4000 to 100,000. The aerogel may include at least one compound selected from the group consisting of a silicon oxide, carbon, a polyimide, and a metal carbide. The aerogel may have a specific surface area in the range of about 100 $cm^3/g$ to 1000 $cm^3/g$. Detailed contents with respect to the polyamideimide resin and the aerogel include the above contents with respect to the example of the insulation coating composition.

The insulation coating layer may be obtained by drying the insulation coating composition. A device or a method used to dry the example of the insulation coating composition may not be particularly limited. For example, a natural drying method at room temperature or greater or a method of drying the insulation coating composition at a temperature of 50° C. or higher may be used, without limitation.

The insulation coating composition may be coated on a coating target, for example, an internal surface of the internal combustion engine or an external surface of a component of the internal combustion engine, the insulation coating composition may be semi-dried at a temperature of about 50° C. to 200° C. at least once, and the semi-dried coating composition may be completely dried at a temperature of about 200° C. or greater such that the insulation coating layer may be formed. However, a detailed method of manufacturing the example of the insulation coating layer may not be limited thereto.

Exemplary embodiments according to the present invention will be described in detail below. However, a following exemplary embodiments only illustrative the present invention, and contents of the present invention are not limited to the following exemplary embodiments.

Exemplary Embodiments 1 to 3

1 Manufacture of Insulation Coating Composition

A porous silica aerogel (having a specific surface area of about 500 $cm^3/g$) dispersed in ethyl alcohol and a polyamideimide resin (product of Solvay Corporation, having a weight average molecular weight of about 11,000) dispersed in xylene are injected into a 20 g reaction device, silica beads of about 440 g are added, and ball milling is performed at a room temperature and normal pressure condition at a speed of about 150 to 300 rpm such that an insulation coating composition (coating solution) is manufactured.

In this case, a weight ratio of the porous silica aerogel to the polyamideimide resin is listed in the following Table 1.

2 Formation of Insulation Coating Layer

The obtained insulation coating composition is coated on a component for a vehicle engine in a spray coating scheme. After the insulation coating composition is coated on the component and is primarily semi-dried at a temperature of about 150° C. for about 10 minutes, the insulation coating composition is recoated and is secondarily semi-dried at about 150° C. for about 10 minutes. After the secondary semi-drying, the insulation coating composition is recoated and is completely dried at a temperature of about 150° C. for about 60 minutes such that the insulation coating layer is formed on the component. In this case, a thickness of the formed coating layer is as listed in the following Table 1.

Comparative Example 1

A polyamideimide resin (product of Solvay Corporation, having a weight average molecular weight of about 11,000) dispersed in xylene is coated on the component for the vehicle engine in a solution (PAI solution) spray coating scheme.

After the PAI solution is coated on the component and is primarily semi-dried at about 150° C. for about 10 minutes, the PAI solution is recoated and is secondarily semi-dried at about 150° C. for about 10 minutes. After the secondary semi-drying, the PAI solution is recoated and is completely dried at a temperature of about 250° C. for about 60 minutes so that the insulation coating layer is formed on the component. In this case, the thickness of the formed coating layer is as listed in the following Table 1.

Comparative Example 2

1 Manufacture of Coating Composition a polyamideimide resin (product of Solvay corporation, having a weight average molecular weight of about 11,000) are injected into a 20 g reaction device, silica beads at about 440 g are added, and ball milling is performed at a room temperature and normal pressure condition at speed of 150 to 300 rpm so that an insulation coating composition (coating solution) is manufactured.

2 Formation of Insulation Coating Layer

A coating layer having a thickness of about 200 μm is formed in the same manner as in Exemplary Embodiment 1.

EXPERIMENT EXAMPLES

1. Experiment Example 1: Measurement of Thermal Conductivity

Thermal conductivity of the coating layer of the component obtained from the exemplary embodiment and the comparative example is measured by a thermal diffusion method using a laser flash method in a room temperature and normal pressure condition according to standard ASTM E1461.

2. Experimental Example 2: Measurement of Heat Capacity

Specific heat of a coating layer on the component obtained from the exemplary embodiment and the comparative example is measured by using sapphire as a reference using a DSC device at a room temperature condition according to standard ASTM E1269, and heat capacity is confirmed.

TABLE 1

| | Aerogel content (weight parts) based on PAI resin 100 weight parts | Coating layer thickness (μm) | Thermal conductivity of coating layer [W/mK] | Heat capacity of coating layer [$KJ/m^3$ K] |
|---|---|---|---|---|
| Exemplary Embodiment 1 | 15 | 120 | 0.54 | 1216 |
| Exemplary Embodiment 2 | 20 | 200 | 0.331 | 1240 |
| Exemplary Embodiment 3 | 40 | 200 | 0.294 | 873 |
| Comparative Example 1 | — | 200 | 0.56 | 1221 |
| Comparative Example 2 | — | 200 | 0.412 | 1255 |

As listed in the Table 1, it is confirmed that the insulation coating layer obtained from the exemplary embodiment 1 to 3 has heat capacity of about 1240 $KJ/m^3$ K or less and a thermal conductivity of about 0.54 W/mK or less in a thickness of the range of about 120 to 200 μm.

Figure 2:
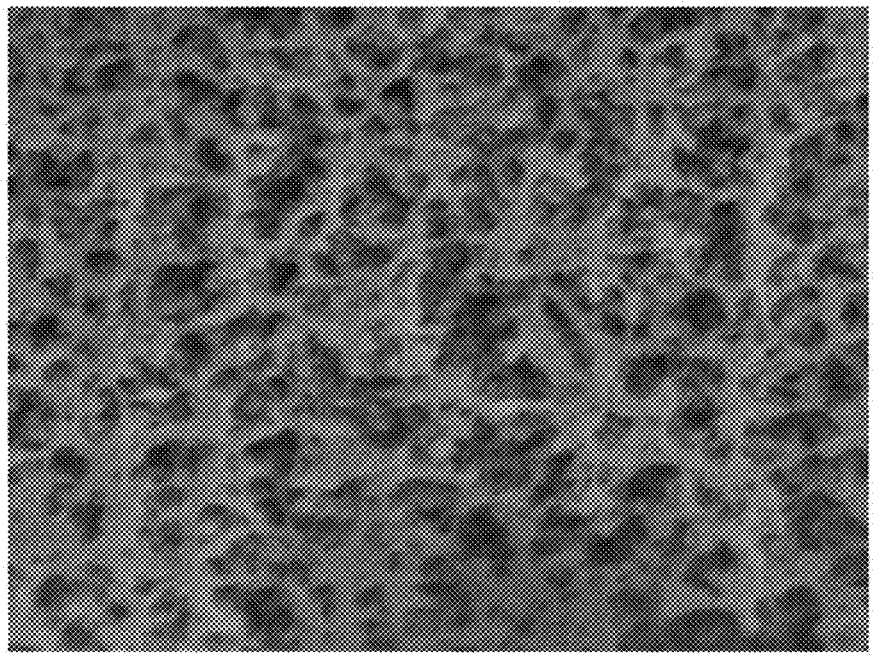
FIG. 2 is a photograph of a surface of an exemplary insulation coating layer obtained by an exemplary embodiment of the present invention.

Further, as illustrated in FIG. 2, in the insulation coating layer manufactured from Exemplary Embodiment 1, a polyamideimide resin does not penetrate into the aerogel and the aerogel may maintain internal pores at about 92%.

Figure 3:
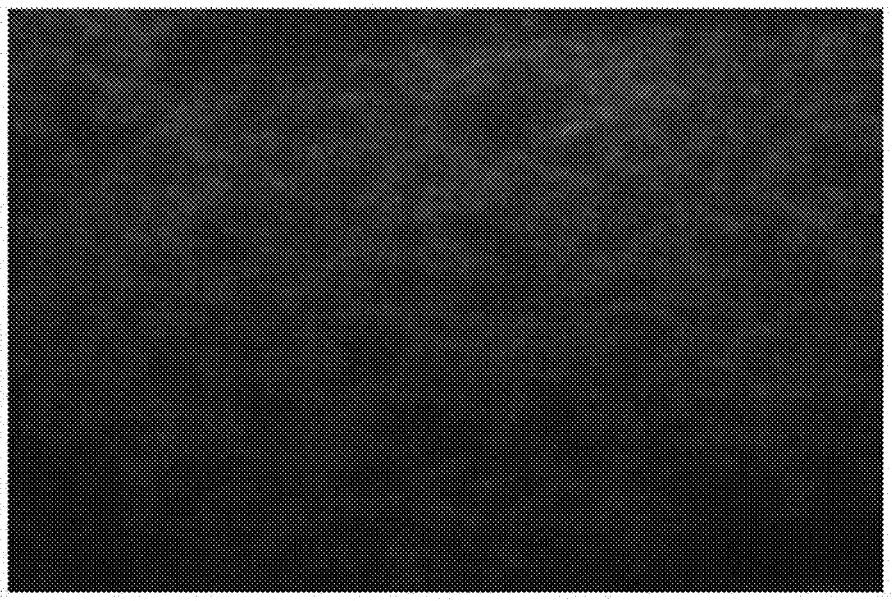
FIG. 3 is a photograph of a surface of a coating layer obtained from a comparative example as compared with the exemplary embodiment depicted in FIG. 2.

In contrast, in the coating layer manufactured from Comparative Example 2, as illustrated in FIG. 3, the polyamideimide resin does not penetrate into the aerogel such that pores are scarcely observed.

With the exemplary cylinder block 100 for an engine according to the present invention as explained herein, the insulation coating layer 50 ensuring high mechanical properties and heat resistance while exhibiting low thermal conductivity and low volume heat capacity may be applied to an external circumferential surface of a lower end portion of the cylinder liner 10.

As a result, the exemplary cylinder block 100 according to the present invention may reduce a heat load of an upper end portion of the cylinder liner 10, prevent over-cooling of a lower end portion thereof, and thereby uniformly maintain temperature distribution of the cylinder liner 10 along a height direction of the water jacket 30 such as a stroke direction of a piston.

That is, according to an exemplary embodiment of the present invention, temperature of a lower end portion side of the cylinder liner 10 may be increased and temperature deviation of the entire cylinder liner 10 may be minimized by applying the insulation coating layer 50 to an external circumferential surface of the lower end portion side of the cylinder liner 10.

Therefore, according to the present invention, cost reduction can be achieved and inside space utilization of the water jacket 30 can become higher because there is no need to install a spacer inside the water jacket 30 unlike the prior art.

Further, fuel consumption can be improved because temperature distribution of the cylinder liner 10 along a height direction of the water jacket 30 is uniformly maintained such that friction loss between a piston and the cylinder liner 10 becomes smaller by oil viscosity reduction, according to an exemplary embodiment of the present invention.

Moreover, deformation of a cylinder bore can be prevented by uniform temperature distribution of the cylinder liner 10, an increase of oil consumption due to deformation of a cylinder bore can be prevented, and a low tension piston ring for improving fuel consumption becomes applicable.

In addition, noise generation can be minimized through reduction of a gap between a piston and the cylinder liner 10 due to reduction of temperature deviation of the cylinder liner 10 along a height direction of the water jacket 30 and durability of the cylinder liner 10 can be improved.

Exemplary embodiments of the present invention are disclosed herein, but the present invention is not limited to the disclosed embodiments, and on the contrary, is intended to cover various modifications and equivalent arrangements included within the appended claims and the detailed description and the accompanying drawings of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A cylinder block for an engine, comprising:

a cylinder liner and a water jacket through which a coolant flows, the water jacket being formed along a circumference of the cylinder liner, wherein an insulation coating layer comprising a polyamideimide resin and an aerogel dispersed in the polyamideimide resin is formed at an external circumferential surface of the cylinder liner, and wherein an amount of 2 wt % or less of the polyamideimide resin based on the total weight of the polyamideimide resin is included in the aerogel.

2. The cylinder block of claim 1, wherein:

the insulation coating layer is formed at the external circumferential surface of a lower portion of the cylinder liner.

3. The cylinder block of claim 2, wherein:

the insulation coating layer has a thermal conductivity of 0.60 W/mK or less.

4. The cylinder block of claim 3, wherein:

the insulation coating layer has a heat capacity of 1250 $KJ/m^3K$ or less.

5. The cylinder block of claim 1, wherein:

the polyamideimide resin is not included at a depth of 5% or greater of a longest diameter from a surface of the aerogel.

6. The cylinder block of claim 1, wherein:

the aerogel has a pore rate in a range of 92% to 99% as being dispersed in the polyamideimide resin.

7. The cylinder block of claim 1, wherein:

the insulation coating layer has a thickness in a range of 50 μm to 500 μm.

8. The cylinder block of claim 1, wherein:

the insulation coating layer comprises the aerogel in an amount of 5 to 50 parts by weight based on the polyamideimide resin at 100 parts by weight.

9. A cylinder block for an engine, comprising:

a cylinder liner and a water jacket through which a coolant flows, the water jacket being formed along a circumference of the cylinder liner, wherein an insulation coating layer is formed at an external circumferential surface of a lower portion of the cylinder liner, wherein the insulation coating layer comprises a polyamideimide resin and an aerogel dispersed in the polyamideimide resin, and has a thermal conductivity of 0.60 W/mK or less and a heat capacity of 1250 $KJ/m^3K$ or less, and wherein the polyamideimide resin is included at a depth of 95% or less of a longest diameter from a surface of the aerogel, and wherein an amount of 2 wt % or less of the polyamideimide resin based on the total weight of the polyamideimide resin is included in the aerogel.

* * * * *